US006019871A

United States Patent [19]

Rökman et al.

[11] Patent Number: 6,019,871

[45] Date of Patent: Feb. 1, 2000

[54] EFFECTIVE UTILIZATION OF SAP IN PRODUCING NON-WOVEN WEBS USING THE FOAM PROCESS

[75] Inventors: Kay Rökman; Juhani Jansson, both of Karhula; Eino Laine, Kyminlinna, all of Finland

[73] Assignee: Ahlstrom Paper Group Oy, Helsinki, Finland

[21] Appl. No.: 09/069,957

[22] Filed: Apr. 30, 1998

[51] Int. Cl.[7] ..... D21H 23/02

[52] U.S. Cl. ..... 162/101; 162/100; 162/123; 162/124; 162/125; 162/127; 162/129; 162/168.1; 162/183; 162/212

[58] Field of Search ..... 162/100, 101, 162/123, 124, 125, 127, 129, 168.1, 157.4, 157.6, 183, 212

[56] References Cited

U.S. PATENT DOCUMENTS

| | | | |
|---|---|---|---|
| 4,344,818 | 8/1982 | Nuttall et al. | 162/129 |
| 4,986,882 | 1/1991 | Mackey et al. | 162/123 |
| 5,607,550 | 3/1997 | Akers | 162/157.4 |
| 5,651,862 | 7/1997 | Anderson et al. | 162/127 |
| 5,795,439 | 8/1998 | Euripides et al. | 162/100 |

*Primary Examiner*—Peter Chin
*Attorney, Agent, or Firm*—Nixon & Vanderhye P.C.

[57] ABSTRACT

The foam process is used to make non-woven webs from cellulose or synthetic fibers, which webs have as a component super absorbent polymer (SAP). In order to minimize water absorbency by the SAP, it may have a protective coating that dissolves only after in contact with water a few seconds; the SAP may be frozen (e.g. to about −18° C.); and/or the SAP may be transported by highly chilled (e.g. about 1° C.) water. The SAP, and liquid or foam carrier, is fed as a small volume flow into a conduit carrying a high volume flow of a fiber containing foam slurry, just before a foraminous element. A mechanical mixer may be provided in the conduit for mixing the SAP with the fiber-foam slurry. The addition of the SAP to the carrier fluid takes place no more than ten seconds (preferably no more than five seconds) before the fiber-foam slurry mixed with SAP is brought into operative association with one or more foraminous elements. The SAP in the formed web, before drying, has a dry content of at least 20% (typically between about 30–40+%).

24 Claims, 4 Drawing Sheets

EFFECTIVE UTILIZATION OF SAP IN PRODUCING NON-WOVEN WEBS USING THE FOAM PROCESS

BACKGROUND AND SUMMARY OF THE INVENTION

The foam laid process for making non-woven webs as an alternative to the liquid laid process has been recognized as highly advantageous in a number of circumstances. One of the significant advantages thereof is the ability to incorporate into the fiber-foam slurry a wide variety of different types and sizes of particles without significantly adversely affecting the formation of the web. Particularly useful in this regard for some circumstances is the ability to add super absorbent polymer particles or fibers ("SAP") to the fiber-foam slurry. Advantageous methods and systems for utilizing SAP or like particles or fibers in the foam process are described in co-pending applications Ser. No. 08/923,900 filed Sep. 4, 1997, and Ser. No. 08/991,548 filed Dec. 16, 1997 (the disclosures of both of which are incorporated by reference herein). According to the present invention a method and system have been created which make much more versatile the addition of SAP and like particles or fibers to the foam slurry, in the production of non-woven webs therefrom.

A significant problem with the addition of SAP to non-woven webs is that the SAP, by its very nature, quickly absorbs any water that it comes into contact with at ambient conditions. Also because of its sticky nature it can interfere with the web forming equipment (foraminous elements, typically called "wires"). This has greatly restricted the ability to utilize SAPs in a wide variety of products or circumstances, and/or has a required a great energy penalty in drying out the web formed so as to drive the water out of the SAP so that it could perform effectively in the non-woven web produced.

According to the present invention, various techniques for specifically providing or handling the SAP particles or fibers, or the like, have been developed which greatly enhance the versatility of using SAPs in the production of non-woven webs, particularly from cellulose or synthetic fibers such as conventional wood pulp, rayon, polyester, or like fibers. By utilizing one or more of the following techniques, the absorption of liquid by the SAPs can be delayed a sufficient time so that the "dry content" (that is the remaining ability to absorb liquid by the SAP as a percentage of its total ability to absorb liquid) is much higher then when handled conventionally, include: utilizing SAP particles or fibers having a protective coating which dissolves only once in contact with water for a few seconds; adding the SAPs to the fiber-foam slurry by entraining the SAP particles or fibers in a small flow of chilled water (typically at a temperature between about 0–5° C., e.g. 0–3° C., preferably 1° C.), and/or freezing the SAP particles or fibers prior to introduction into the foam-fiber slurry (reducing their temperature to below 0° C., e.g. to the conventional temperature reached by normal freezers or the like, e.g. about −18° C.). Also, the SAP is added to the fiber-foam slurry just prior to web formation (in a headbox, or other device containing the foraminous element or elements), typically about ten seconds or less before web formation starts, and more preferably about five seconds or less (e.g. about three seconds) before web formation is initiated.

The results achieved according to the invention compared to the prior art may be quite dramatic. For example using the conventional prior art techniques where ambient SAP is added to the fiber-foam slurry about ten seconds before web formation is initiated, the dry content of the SAP in the web after web formation is about 10–15%. Using SAP that is reduced in temperature to −18° C., however, and adding it about ten seconds before web formation results in a dry content of the SAP in the non-woven web produced of between about 20–25%. Where water at about 1° C. is used to transport the SAP the dry content in the final web is between about 30–35%, while if the chilled water and the low temperature SAP are combined the dry content of the SAP in the formed web is between about 33–38%. If conventional coated SAP is used and added about ten seconds prior to web formation, the dry content of SAP in the final web produced is about 40%, whereas if coated SAP that is also reduced in temperature to about −18° C. and added with chilled water, is used, the dry content is about 42%. Even higher dry contents can be achieved if the addition occurs about five seconds or less before web formation, and in any event all of the techniques according to the invention result in greatly reduced drying energy and/or time, making the web formation process much more cost effective and simpler for a wide variety of products, including products used in diapers, absorbent pads, and the like.

According to one aspect of the present invention a method of producing a non-woven web of cellulose or synthetic fibrous material (using the foam process) is provided. The method comprises the following steps: (a) Forming a first foam slurry of air, water, cellulose or synthetic fibers, and surfactant. (b) Moving a first foraminous element in a first path. (c) Passing the first foam slurry into operative contact with the first foraminous material moving in the first path. (d) Adding super absorbent polymer to the first foam slurry, and positively mixing it with the first foam slurry, about ten seconds or less before step (c). And, (e) forming a fibrous web from the first foam slurry by withdrawing foam and liquid from the slurry through the first foraminous element. Step (a) is a typical fiber-foam slurry step as described in co-pending application Ser. No. 08/923,900 filed Sep. 4, 1997.

Steps (a) through (e) are typically practiced so that the dry content of the super absorbent polymer after step (e), and before drying, is at least about 20% (typically at least about 30%, and more desirably at least about 40%).

Step (d) may be practiced by adding SAP having a protective coating that dissolves after a few seconds in contact with water, in which case steps (a) through (e) are typically practiced so that the dry content of the SAP after step (e), and before drying, is at least about 35%. Step (d) may alternatively or additionally be practiced by adding SAP at a temperature of below 0° C. (e.g. about −18° C.). Step (c) is typically practiced at a first flow rate, and step (d) may be alternatively or additionally practiced by adding SAP to a flow of liquid water having a temperature between about 0–5° C., preferably between about 0–3° C., (e.g. 1° C.) having a second flow rate, less than about 2% (e.g. less than about 1%) of the first flow rate, and then passing the liquid with SAP into the first foam slurry.

Step (d) is typically further practiced by mechanically mixing the liquid and SAP with the first foam slurry after the liquid and SAP have been added to the first foam slurry, such as by using a conventional mechanical mixer with a rotating blade. Step (d) may alternatively or further be practiced by adding SAP to a second fiber-foam slurry having a solids consistency of between about 5–50%, and pumping the second slurry with SAP into the first slurry, mixing inherently occurring during this pumping. Step (d) is preferably practiced about five seconds or less (e.g. about three seconds) before step (c). There is typically also the further step (f) of drying the web so that the SAP therein has a dry content of at least about 98% (preferably close to 100%). The drying is practiced in a conventional manner, e.g. using a conventional blown hot air system, or conventional drying oven. While the SAP in the final web will pick up some moisture during transport to its final use destination, it typically will have a dry content of at least about 95% when used.

The method of the invention may also comprise the further steps of (g) moving a second foraminous material in a second path; (h) making up a second foam slurry of air, water, cellulose or synthetic fibers, and surfactant; and (i) passing the second foam slurry into direct contact with the second foraminous material; and wherein step (e) is practiced to bring the first and second foam slurries into contact with each other and so that foam and liquid is withdrawn through both the first and second foraminous materials; and also optionally the further steps of (j) making a third foam slurry of air, water, cellulose or synthetic fibers, and surfactant; and (k) moving the third foam slurry directly into contact with the first foraminous material; and wherein step (c) is practiced by passing the first foam slurry between the second and third foam slurries, so that the first foam slurry does not directly contact the foraminous materials. Alternatively step (c) may be practiced by passing the first foam slurry directly into contact with the first foraminous material if build-up problems are avoided because of the entrainment of the SAP in the fiber-foam slurry.

According to another aspect of the present invention a method of producing a non-woven web is provided comprising the following steps: (a) Forming a first foam slurry of air, water, cellulose or synthetic fibers, and surfactant. (b) Moving a first foraminous element in a first path. (c) Passing the first foam slurry into operative contact with the first foraminous material moving in the first path. (d) Adding super absorbent polymer having a protective coating that dissolves after a few seconds in contact with water to the first foam slurry, and positively mixing it with the first foam slurry. And, (e) forming a fibrous web from the first foam slurry by withdrawing foam and liquid from the slurry through the first foraminous element. And, wherein steps (a)–(e) are practiced so that the dry content of the super absorbent polymer after step (e), and before drying, is at least about 35%.

According to yet another aspect of the invention a method of producing a non-woven web is provided comprising the steps of: (a) Forming a first foam slurry of air, water, cellulose or synthetic fibers, and surfactant. (b) Moving a first foraminous element in a first path. (c) Passing the first foam slurry into operative contact with the first foraminous material moving in the first path. (d) Adding super absorbent polymer at a temperature of below zero degrees C to the first foam slurry, and positively mixing it with the first foam slurry. And, (e) forming a fibrous web from the first foam slurry by withdrawing foam and liquid from the slurry through the first foraminous element. And, wherein steps (a)(e) are practiced so that the dry content of the super absorbent polymer after step (e), and before drying, is at least about 20%.

According to another aspect of the invention a method of producing a non-woven web is provided comprising the following steps: (a) Forming a first foam slurry of air, water, cellulose or synthetic fibers, and surfactant. (b) Moving a first foraminous element in a first path. (c) Passing the first foam slurry into operative contact with the first foraminous material moving in the first path at a first flow rate. (d) Adding super absorbent polymer to the first foam slurry, and positively mixing it with the first foam slurry by adding super absorbent polymer to a flow of liquid having a second flow rate, less than about 2% of the first flow rate, and then passing the liquid with super absorbent polymer into the first foam slurry. And, (e) forming a fibrous web from the first foam slurry by withdrawing foam and liquid from the slurry through the first foraminous element. And, wherein steps (a)–(e) are practiced so that the dry content of the super absorbent polymer after step (e), and before drying, is at least about 25%. Step (d) is typically further practiced by using liquid water having a temperature of between about 0–5° C., and step (d) is also further practiced by mechanically mixing the liquid and super absorbent polymer with the first foam slurry after the liquid and super absorbent polymer have been added to the first foam slurry; and step (d) may also be further practiced by adding super absorbent polymer at a temperature of below zero degrees C.; and wherein steps (a)–(e) are practiced so that the dry content of the super absorbent polymer after step (e), and before drying, is at least about 33%.

According to another aspect of the present invention a system for producing a non-woven fibrous web is provided comprising the following components: A first foraminous element on which a non-woven fibrous web may be formed. A first conduit for feeding a fiber containing foam slurry to the first element. A mechanical mixer disposed in the first conduit adjacent the foraminous element. And, an inlet for introducing absorbent polymer into the feed conduit on the opposite side of the mixer from the first foraminous element, to effect mixing of super absorbent polymer and fiber containing foam within the feed conduit.

The system may further comprise a second conduit connected to the inlet, the second conduit having a cross-sectional area not more than 10% of the cross-sectional area of the first conduit. A pump may be provided in the second conduit, and means may be provided for separately feeding SAP and water (or other transporting fluid) into the second conduit on the opposite side of the pump from the inlet.

The system may further comprise a chiller operatively connected to the means for feeding water into the second conduit, the chiller capable of cooling water flowing to the second conduit to a temperature of about 3° C. or less. The means for feeding super absorbent polymer to the second conduit comprises a freezer capable of reducing the temperature of the super absorbent polymer below 0° C., a weighing device, and a metering device.

The system may also include a tank having a fluid level therein and connected to the opposite side of the pump from the inlet; and means for separately feeding super absorbent polymer and fiber containing foam into the tank below the fluid level therein.

It is the primary object of the present invention to provide an enhanced foam process for the production of non-woven webs that utilize SAP particles or fibers therein, and a system for practicing such a method. This and other objects of the invention will become clear from an inspection of the detailed description of the invention and from the appended claims.

DETAILED DESCRIPTION OF THE DRAWINGS

Figure 1:
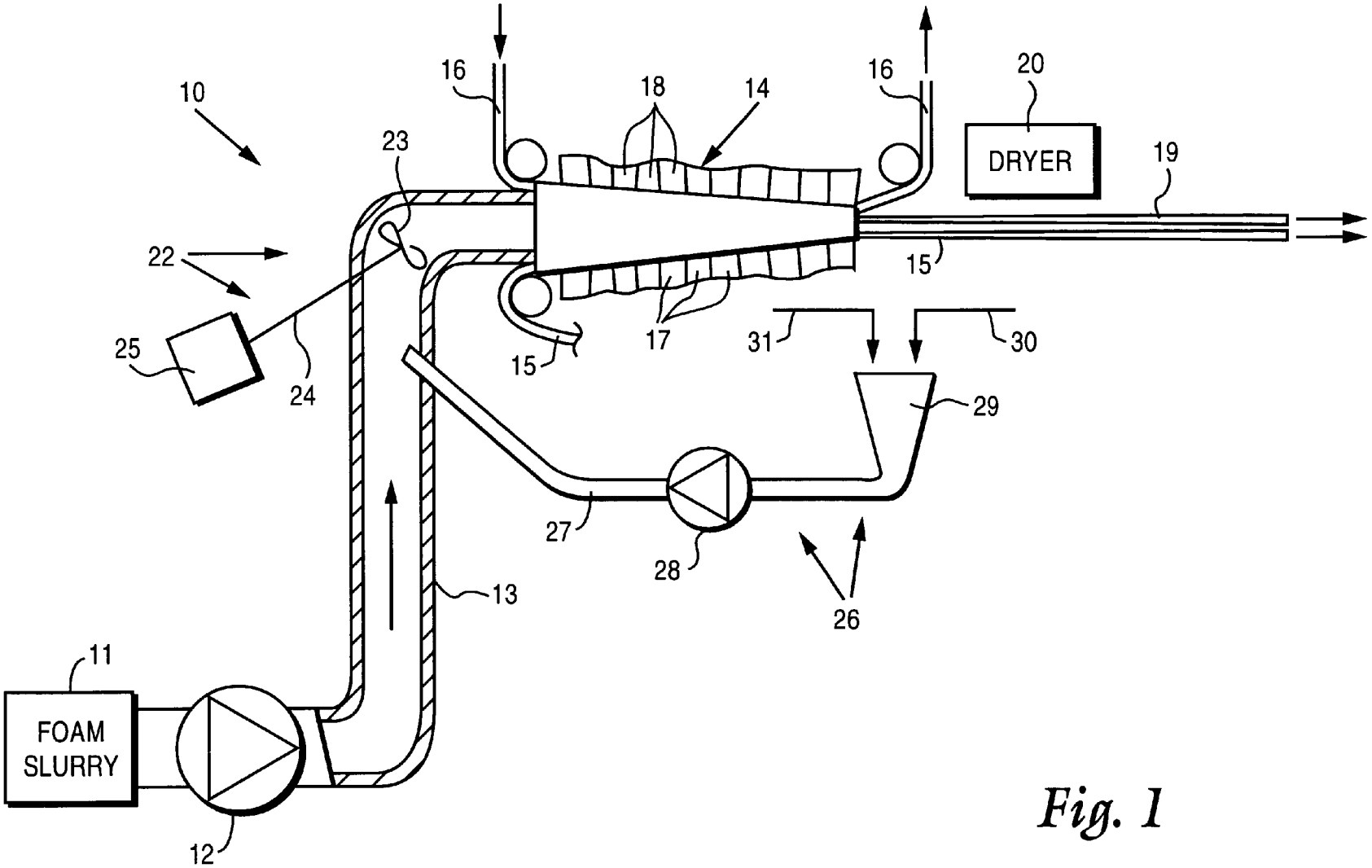
FIG. 1 is a side schematic view, partly in cross-section and partly in elevation, of an exemplary system for practicing the exemplary method according to the present invention.

An exemplary system for producing a non-woven fibrous web is illustrated schematically at 10 in FIG. 1. The system 10 includes a fiber-foam slurry creating system shown schematically at 11, and conventional per se, being fully illustrated in co-pending application Ser. No. 08/923,900 filed Sep. 4, 1997. The slurry is pumped by a pump 12 (with a typical solids content, and other conditions, as described in the co-pending application) to a first conduit 13 for feeding the fiber containing foam slurry (as indicated by the directional arrow in conduit 13) to a web forming device 14. The forming device 14 is conventional per se, and includes at least a first foraminous element 15. A second foraminous element (wire) 16 may also be provided, the elements/wires 15, 16 being directed in a conventional manner into contact with the fiber-foam slurry to produce a web. Conventional suction boxes 17, 18, or other conventional devices (such as suction rollers, or the like) withdraw foam and liquid from the slurry through one or both of the foraminous elements 15, 16 to produce the non-woven web 19. The web 19 is dried using a conventional dryer 20 (e.g. blowing hot air on the web 19, a conventional drying oven, or the like).

The system 10 of FIG. 1 also preferably includes a mixer 22 which mixes SAP or like material added to the fiber-foam slurry in the conduit 13, with the fiber-foam slurry. For example the mixer 22 is a conventional mechanical mixer including a rotating blade 23 (shown as a propeller blade schematically in FIG. 1, but having any conventional shape) driven by rotating the shaft 24 using a conventional motor or other power source 25.

The SAP or the like is added to the fiber foam slurry using the inlet conduit 27, which introduces the SAP into the fiber-foam slurry in conduit 13 just prior to the mixing blade 23. The SAP system 26, in addition to including the inlet conduit 27, includes a pump 28, a receptacle 29 for the addition of SAP and transporting fluid to the inlet conduit 27, and material flows 30, 31 for the SAP and for chilled water, as will be hereinafter described with respect to FIG. 2.

Figure 2:
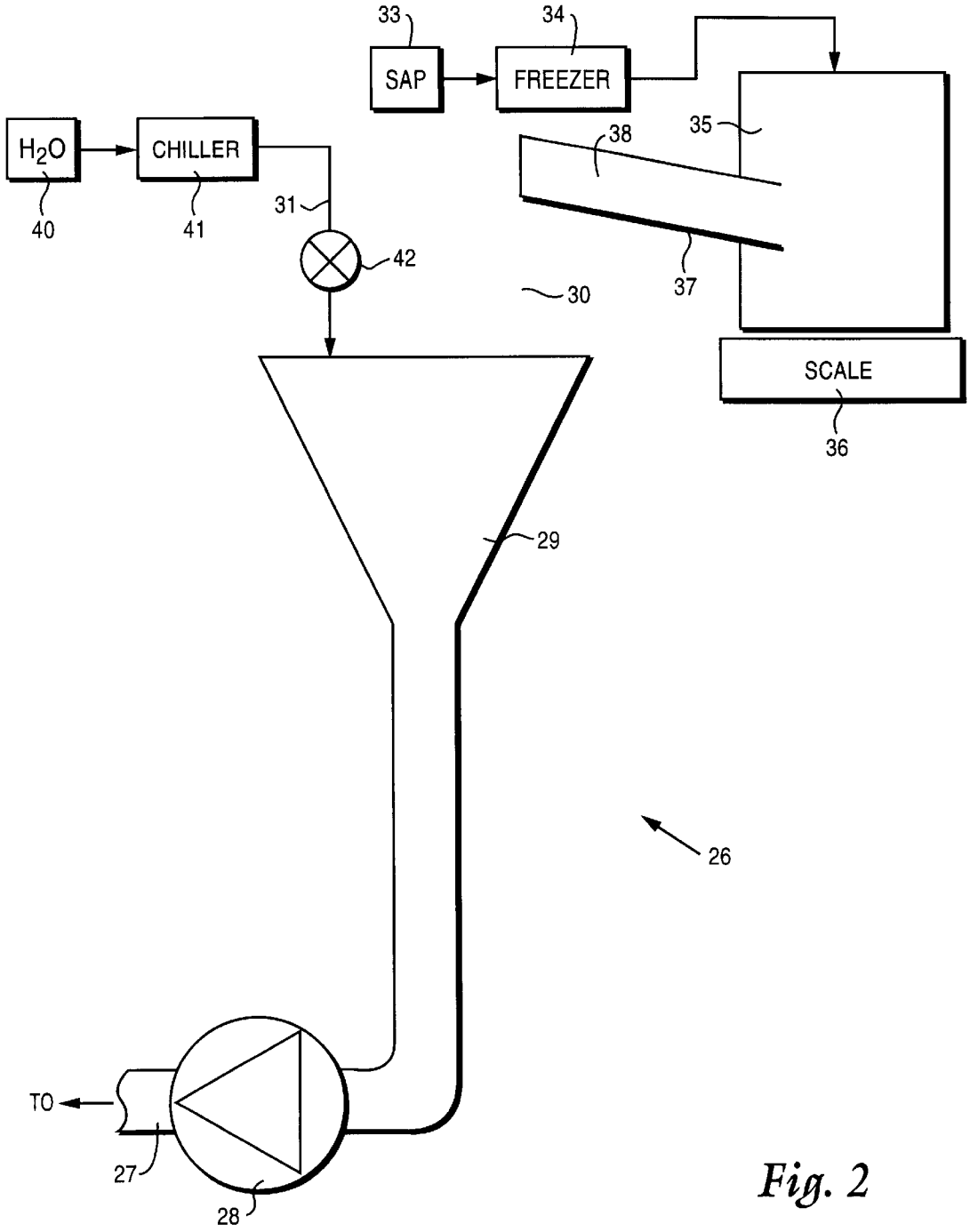
FIG. 2 is an enlarged schematic view of the SAP feed components of the system of FIG. 1.

FIG. 2 schematically illustrates but in more detail the system 26. The SAP flow, illustrated schematically at 30 in FIGS. 1 and 2, may typically be provided by taking a source of conventional SAP 33 (such as bags of particulate SAP), and placing the SAP in a freezer 34 or the like. The freezer 34 may be a conventional freezer that is capable of reducing the temperature of the SAP from source 33, over time, to about minus 18° C., but in any event below 0° C. The SAP is taken from the freezer 34 either continuously, or as needed, either automatically or manually, and added to the hopper 35 which is operatively connected to a scale 36 or like weighing device, as is conventional per se. From the container 35 a conduit 37 extends having a screw feeder 38 or the like therein, which moves the SAP from the vessel 35 to flow into the open top of the receptacle 29.

The material addition 31 is the addition of chilled water. Water 40 from a readily available source is passed through a conventional chiller 41 to reduce the temperature thereof to just above freezing. The temperature must be enough above freezing so that ice formation does not significantly interfere with the flow of the liquid, but should be close enough to freezing as possible so as to reduce the temperature to about 0–5° C., e.g. about 0–3° C., preferably about 1° C. A conventional valve 42, either manually or automatically operated, may be utilized to meter the flow of the chilled water into the receptacle 29.

The flow rate of the fiber-foam slurry in the conduit 13 is much greater than the flow rate of the SAP and chilled water in inlet conduit 27. The flow rate in the inlet conduit 27 is about 2% or less of the flow rate in the conduit 13. For example in one exemplary practice of the invention, the fiber-foam slurry flow rate in the conduit 13 may be 6,000 liters per minute, while the flow of chilled water in the inlet conduit 27 is only on the order of about 20 liters per minute. The cross-sectional area of the conduit 27 is typically 10% or less of that of the conduit 13, and the pumps 12, 28 are operated so as to give the desired relative flow rates.

The inlet conduit 27 is located as close to the headbox 14 or other formation equipment, including the foraminous elements 15, 16, as possible so as to reduce the time that the SAP is in contact with the liquid component of the fiber-foam slurry. The time from the receptacle 29 to the headbox 14 (or like web formation position) is preferably about ten seconds or less, more preferably about five seconds or less (e.g. about three or four seconds). This is accomplished by positioning of the components close to each other, and operating the equipment at desired absolute and relative speeds.

While FIG. 2 illustrates both chilling the water in line 31 and freezing the SAP 30 it is to be understood that only one of those two techniques need be utilized, or instead (or in addition) the SAP having a protective coating which dissolves only after in contact with water for a few seconds, may be utilized. When just the frozen SAP is utilized one can expect a dry content of the SAP in the final web 19 (before the dryer 20) produced to be, if the time from receptacle 29 to the web formation at 14 is about ten seconds, about 20–25%. If only the water chilled to about 1° C. used in the line 31 is used, the final dry content may be expected to be about 30–35%. If both the frozen SAP and chilled water are used the dry content may be expected to be between about 33–38%. If the coated SAP alone is used the dry content may be expected to be about 40%, and if coated SAP is used with the freezer 34 and chiller 41 as illustrated in FIG. 2, the dry content of the SAP may be expected to be about 40% in the final web 19. All these values are given assuming the time from receptacle 29 to the web formation at 14 is about ten seconds, but if the time is reduced to about five seconds or less then the dry content will be even higher.

Figure 3:
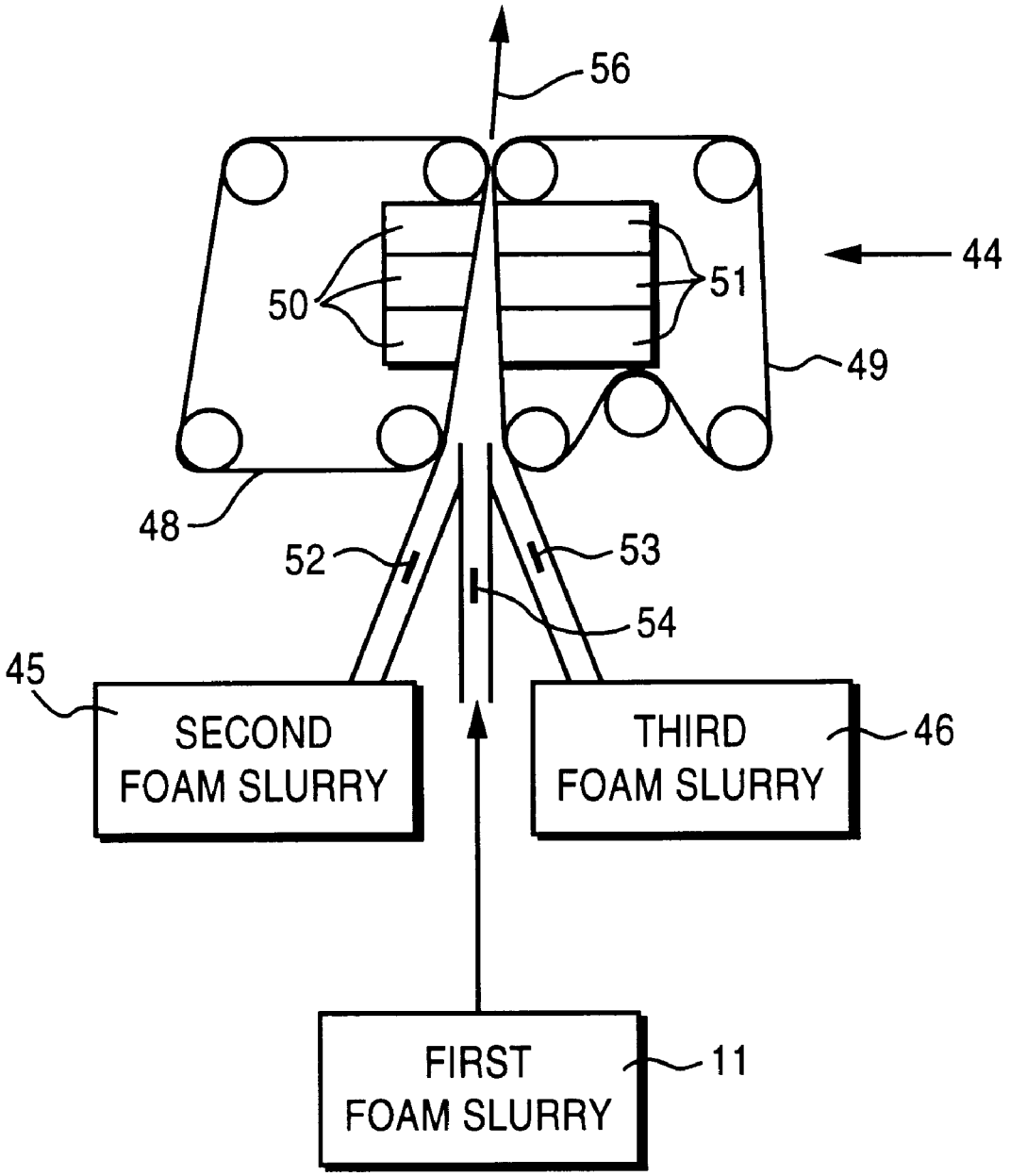
FIG. 3 is a schematic view illustrating another embodiment for web formation according to the present invention.

FIG. 3 illustrates another system 44 according to the invention. In addition to the first foam slurry 11 a second foam slurry 45 and a third foam slurry 46 are produced, the slurries 45, 46 also containing fiber, surfactant, and the like just like the slurry 11, although the percentage or types of fibers and other components may be varied as necessary or desirable. The system 44 further comprises a first foraminous element (wire) 48 and a second foraminous element 49, the elements 48, 49 having the suction boxes 50, 51, or like suction devices, associated therewith. The slurries are fed using the conduits/channels 52 through 54, as illustrated in FIG. 3, so that the second foam slurry 52 comes into contact with the first foraminous element 48, the third foam slurry in conduit 53 comes into direct contact with the second foraminous element 49, and the first foam slurry in conduit 54 goes between them and does not substantially contact either of the wires 48, 49. It is the first foam slurry 11 that has had the SAP added thereto, as illustrated in FIGS. 1 and 2. The SAP addition takes place just prior to the conduit 54 introduction into the system 44, and a mechanical mixer—as illustrated at 22 in FIG. 1–may also be utilized if desired.

Figure 4:
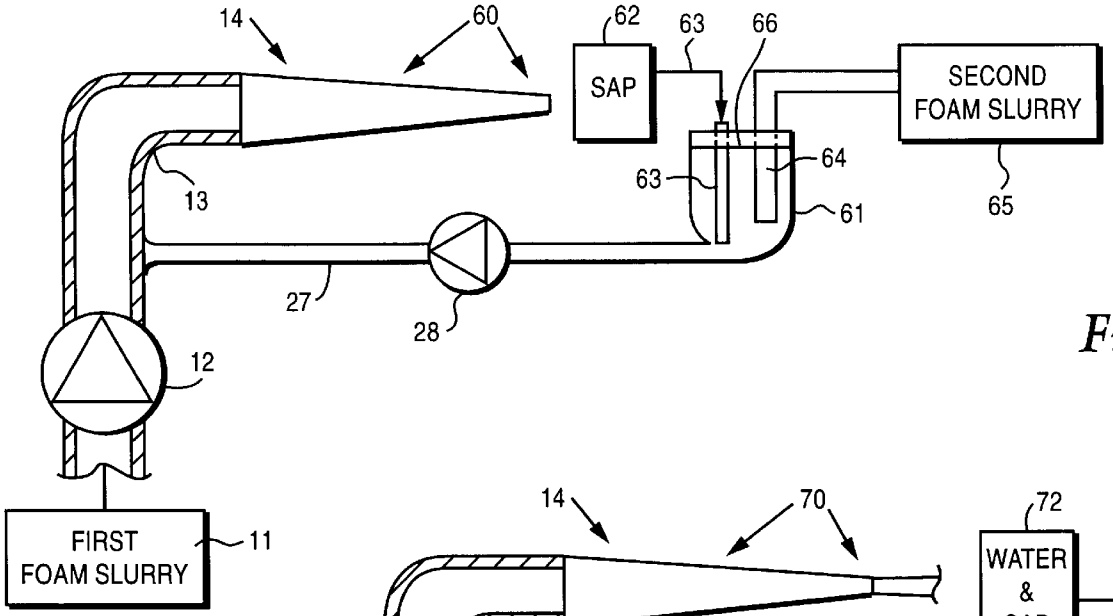
FIGS. 4 and 5 are views like that of FIG. 1 only showing alternative mechanisms for practicing the method according to the invention.
Figure 5:
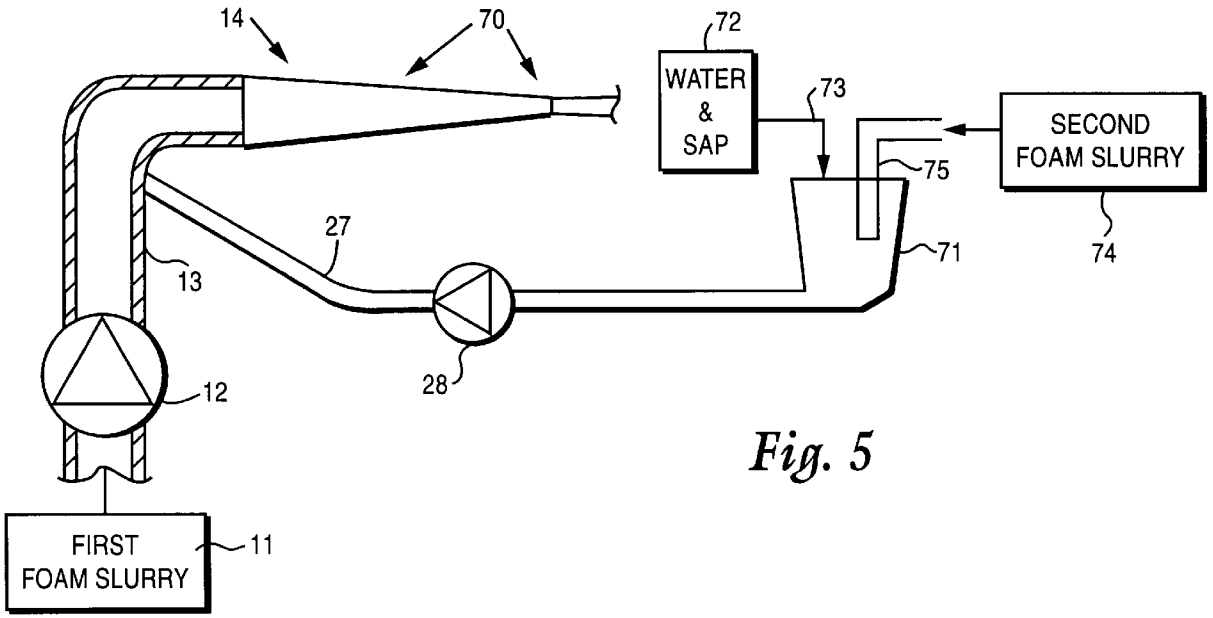

FIGS. 4 and 5 illustrate alternative systems to that of FIGS. 1 and 2, or FIG. 3.

In FIG. 4 components having the same configuration as those illustrated in FIG. 1 are shown by the same reference numeral. The system 60 is preferably essentially the same as the system 10 from the inlet conduit 27 to the headbox 14 or the like, although the mixer 22 need not be provided (although it is still preferable), but the SAP introduction is different. A small volume vessel 61 (so that residence time therein is minimal, and does not provide for significant exposure of SAP to liquid) is connected up to a source of SAP 62 via a conduit 63. Preferably the conduit 63 extends down into the tank 61 as far as feasible so as to minimize contact of the SAP 62 with liquid, while a conduit 64 introduces a second fiber-foam slurry from the source 65. The second fiber-foam slurry 65 will reach a level 66 in the vessel 61, with the conduit 63 introducing the SAP below that level. The pump 28, when pumping the fiber-foam slurry and the SAP from sources 65, 62, respectively, will inherently mix them together before introduction into the conduit 13. Of course the SAP at 62 may be frozen and/or provided with a protective coating, as described above with respect to the FIGS. 1 and 2 embodiment.

In the system 70 of FIG. 5 components comparable to those in the FIGS. 1 and 2 embodiment are shown by the same reference numeral. The primary difference between the FIG. 5 embodiment and that of FIGS. 1 and 2 is that in the vessel 71 the chilled water and SAP from source 72 are added by a conduit 73, while a second fiber-foam slurry from the source 74 is added by the conduit 75. Therefore the pump 28 when pumping the chilled water, SAP, and second fiber-foam slurry inherently mixes the fiber-foam slurry with the SAP before introduction into the conduit 13. In both the FIGS. 4 and 5 embodiment the second fiber-foam slurry 65, 74 has a consistency that is desirably between about 5–50%. Preferably the second fiber-foam slurry in the sources 65, 74 has essentially the same properties as the first fiber foam slurry 11, as far as type of fiber, consistency, etc. are concerned, although in some circumstances the properties can differ for various intended effects.

Using the systems of FIGS. 1 through 5 it is clear that a method of producing a non-woven web of cellulose synthetic fibrous material that includes super absorbent polymer therein having an enhanced dry content compared to the prior art, is provided. The dry content of the SAP in the webs produced is preferably as described above, according to the invention typically having a minimum of about 20% and going up to 42% or more even when the time from SAP addition to transporting fluid to the web former is about ten seconds (being higher when the time is desirably reduced to about five seconds or less). For example with respect to FIGS. 1 and 2, the first foam slurry of air, water, cellulose or synthetic fibers, and surfactant is formed as indicated at 11, a first foraminous element (e.g. 15 or 16) is moved in a first path, and the first fiber foam slurry is moved into operative contact with the foraminous material 15, 16, for example via the pump 12 and conduit 13. Super absorbent polymer is added to the first foam slurry using the inlet conduit 27, and the super absorbent polymer and fiber-foam slurry are positively and intimately mixed, as by the mixer 22. The addition of SAP is about ten seconds or less (preferably about five seconds or less) before the passage of the fiber-foam slurry into contact with the foraminous element or elements 15, 16. The fibrous web 19 is then formed from the first fiber-foam slurry by withdrawing foam and liquid from the slurry through the first foraminous element, e.g. using the suction boxes 18 or like conventional structures.

All of the various process conditions can vary widely, as described in the co-pending applications incorporated by reference herein. Typically the SAP concentration in the inlet line 27, whether chilled water or a fiber-foam slurry is used as the transporting fluid, is between about 20–50%, and the flow rate is low enough so that it does not significantly affect the solids concentration of the fiber-foam slurry in the conduit 13. The dryer 20 is operated so as to preferably remove at least about 90% of the water from the SAP so that it has a dry content of about 98% or more. By practicing the invention the SAP particles in the final web 15 are separated from each other so that channels are provided therebetween which allow wicking of the moisture.

Another way that the dry content of the SAP can be enhanced is to mix a suitable salt, such as sodium sulphate or ammonium sulphate, with the SAP at 33, 62, or 72. The salt will decompose due to heat in the system, or can be washed out of the suspension, but can enhance the dry content of the SAP either alone, or combined with one or more of the above discussed techniques.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and systems.

What is claimed is:

1. A method of producing a non-woven web of cellulose or synthetic fibrous material, comprising the steps of:

(a) forming a first foam slurry of air, water, cellulose or synthetic fibers, and surfactant;

(b) moving a first foraminous element in a first path;

(c) passing the first foam slurry into operative contact with the first foraminous material moving in the first path;

(d) adding super absorbent polymer to the first foam slurry, and positively mixing it with the first foam slurry, about ten seconds or less before step (c); and (e) forming a fibrous web from the first foam slurry by withdrawing foam and liquid from the slurry through the first foraminous element.

2. A method as recited in claim 1 wherein steps (a)–(e) are practiced so that the dry content of the super absorbent polymer after step (e), and before drying, is at least about 20%.

3. A method as recited in claim 1 wherein step (d) is practiced by adding a super absorbent polymer having a protective coating that dissolves after a few seconds in contact with water; and wherein steps (a)–(e) are practiced so that the dry content of the super absorbent polymer after step (e), and before drying, is at least about 35%.

4. A method as recited in claim 2 wherein step (d) is practiced by adding super absorbent polymer at a temperature of below zero degrees C.

5. A method as recited in claim 2 wherein step (c) is practiced at a first flow rate, and wherein step (d) is practiced by adding super absorbent polymer to a flow of liquid having a second flow rate, less than about 2% of the first flow rate, and then passing the liquid with super absorbent polymer into the first foam slurry.

6. A method as recited in claim 5 wherein step (d) is further practiced by using liquid water having a temperature of between about 0–5 degrees C.

7. A method as recited in claim 6 wherein step (d) is further practiced by mechanically mixing the liquid and super absorbent polymer with the first foam slurry after the liquid and super absorbent polymer have been added to the first foam slurry.

8. A method as recited in claim 7 wherein step (d) is further practiced by adding super absorbent polymer at a temperature of below zero degrees C.; and wherein steps (a)–(e) are practiced so that the dry content of the super absorbent polymer after step (e), and before drying, is at least about 30%.

9. A method as recited in claim 2 wherein step (d) is practiced by adding super absorbent polymer to a second fiber-foam slurry having a solids consistency of between about 5–50%, and then pumping the second slurry with polymer into the first slurry, mixing occurring during pumping.

10. A method as recited in claim 2 wherein step (d) is practiced about 5 seconds or less before step (c).

11. A method as recited in claim 10 wherein step (c) is practiced at a first flow rate, and wherein step (d) is practiced by adding a super absorbent polymer having a protective coating that dissolves after a few seconds in contact with water and at a temperature of below zero degrees C.; and by adding the super absorbent polymer to a flow of liquid water having a temperature of between about 0–5 degrees C. and having a second flow rate, less than about 2% of the first flow rate, and then passing the liquid with super absorbent polymer into the first foam slurry; and wherein steps (a)–(e) are practiced so that the dry content of the super absorbent polymer after step (e), and before drying, is at least about 40%.

12. A method as recited in claim 2 comprising the further step (f) of drying the fiber web so that the super absorbent polymer therein has a dry content of at least about 98%.

13. A method as recited in claim 2 comprising the further steps of (g) moving a second foraminous material in a second path; (h) making up a second foam slurry of air, water, cellulose or synthetic fibers, and surfactant; and (i) passing the second foam slurry into direct contact with the second foraminous material; and wherein step (e) is practiced to bring the first and second foam slurries into contact with each other and so that foam and liquid is withdrawn through both the first and second foraminous materials.

14. A method as recited in claim 13 comprising the further steps of (j) making a third foam slurry of air, water, cellulose or synthetic fibers, and surfactant; and (k) moving the third foam slurry directly into contact with the first foraminous material; and wherein step (c) is practiced by passing the first foam slurry between the second and third foam slurries, so that the first foam slurry does not directly contact the foraminous materials.

15. A method as recited in claim 2 wherein step (c) is practiced by passing the first foam slurry directly into contact with the first foraminous material.

16. A method of producing a non-woven web of cellulose or synthetic fibrous material, comprising the steps of:

(a) forming a first foam slurry of air, water, cellulose or synthetic fibers, and surfactant;

(b) moving a first foraminous element in a first path;

(c) passing the first foam slurry into operative contact with the first foraminous material moving in the first path;

(d) adding super absorbent polymer having a protective coating that dissolves after a few seconds in contact with water to the first foam slurry, and positively mixing it with the first foam slurry; and (e) forming a fibrous web from the first foam slurry by withdrawing foam and liquid from the slurry through the first foraminous element; and wherein steps (a)–(e) are practiced so that the dry content of the super absorbent polymer after step (e), and before drying, is at least about 35%.

17. A method of producing a non-woven web of cellulose or synthetic fibrous material, comprising the steps of:

(a) forming a first foam slurry of air, water, cellulose or synthetic fibers, and surfactant;

(b) moving a first foraminous element in a first path;

(c) passing the first foam slurry into operative contact with the first foraminous material moving in the first path;

(d) adding super absorbent polymer at a temperature of below zero degrees C. to the first foam slurry, and positively mixing it with the first foam slurry; and (e) forming a fibrous web from the first foam slurry by withdrawing foam and liquid from the slurry through the first foraminous element; and wherein steps (a)–(e) are practiced so that the dry content of the super absorbent polymer after step (e), and before drying, is at least about 20%.

18. A method of producing a non-woven web of cellulose or synthetic fibrous material, comprising the steps of:

(a) forming a first foam slurry of air, water, cellulose or synthetic fibers, and surfactant;

(b) moving a first foraminous element in a first path;

(c) passing the first foam slurry into operative contact with the first foraminous material moving in the first path at a first flow rate;

(d) adding super absorbent polymer to the first foam slurry, and positively mixing it with the first foam slurry by adding super absorbent polymer to a flow of liquid having a second flow rate, less than about 2% of the first flow rate, and then passing the liquid with super absorbent polymer into the first foam slurry; and (e) forming a fibrous web from the first foam slurry by withdrawing foam and liquid from the slurry through the first foraminous element; and wherein steps (a)–(e) are practiced so that the dry content of the super absorbent polymer after step (e), and before drying, is at least about 25%.

19. A method as recited in claim 18 wherein step (d) is further practiced by using liquid water having a temperature of between about 0–5 degrees C.

20. A method as recited in claim 19 wherein step (d) is further practiced by mechanically mixing the liquid and super absorbent polymer with the first foam slurry after the liquid and super absorbent polymer have been added to the first foam slurry.

21. A method as recited in claim 20 wherein step (d) is further practiced by adding super absorbent polymer at a temperature of below zero degrees C.; and wherein steps (a)–(e) are practiced so that the dry content of the super absorbent polymer after step (e), and before drying, is at least about 33%.

22. A method as recited in claim 19 wherein step (d) is practiced about five seconds or less before step (c).

23. A method as recited in claim 17 wherein step (d) is practiced about five seconds or less before step (c).

24. A method as recited in claim 16 wherein step (d) is practiced about five seconds or less before step (c).

* * * * *